United States Patent [19]

Sands et al.

[11] Patent Number: 4,811,729

[45] Date of Patent: Mar. 14, 1989

[54] RECOMPRESSION CHAMBER

[75] Inventors: Robert L. Sands, Kempsey; John Pennefather, Frenchs Forest, both of Australia

[73] Assignee: Paracel Holdings Pty. Limited, Kempsey, Australia

[21] Appl. No.: 52,572

[22] Filed: May 20, 1987

[30] Foreign Application Priority Data

May 21, 1986 [AU] Australia ..... PH6019

[51] Int. Cl.[4] ..... A61M 16/02

[52] U.S. Cl. ..... 128/202.12; 128/205.26

[58] Field of Search ..... 128/1 B, 1 R, 202.12, 128/205.26

[56] References Cited

U.S. PATENT DOCUMENTS 2,401,230 5/1946 Cooley ..... 128/205.26 X 4,011,867 3/1977 Arntzen ..... 128/205.26

4,467,798 8/1984 Saxon ..... 128/202.12 X

*Primary Examiner*—Alan Cohan

*Attorney, Agent, or Firm*—Poms, Smith, Lande & Rose

[57] ABSTRACT

A recompression chamber is disclosed comprising a frusto-conical shell with an end wall closing the base of the shell and having a sealable hatch in the end wall to provide access to the chamber. The chamber may be tilted endwise to vary the position of the patient lying in the chamber. The chamber is dimensioned to accommodate a patient lying down with his feet towards the apex of the shell and an attending medical technician sitting adjacent the sealable hatch. The hatch is also provided with a rotatable bayonet fitting to enable a further chamber to be attached thereto to provide for a transfer under pressure between the chambers.

7 Claims, 4 Drawing Sheets

RECOMPRESSION CHAMBER

The present invention relates to recompression chambers which are conventionally used in the treatment of baratrauma and particularly to portable recompression chambers.

Known recompression chambers are essentially cylindrical with a hemispherical portion at each end thereof. Being so configured, in order to accommodate both a patient and an attending medical technician they must be of considerable internal dimensions. So dimensioned the wall thickness of the chamber must be considerable to contain the requisite elevated internal pressure and therefore they are inconveniently massive.

Furthermore, during the treatment of particular types of baratrauma such as air embolism it is imperative that the patient be inclined at a 30° head down angle. To obtain this inclination it is necessary due to internal constraints to incline the compression chamber which can be extremely difficult when using conventional pressure chambers.

It is an object of the present invention to provide a recompression chamber which is sufficiently spacious to accommodate a patient and an attending medical technician and yet small enough of external dimensions and therefore of mass to facilitate relatively easy transportation.

A further object of the present invention is to provide a recompression chamber which may be readily inclined to thereby incline a patient within the chamber.

The invention achieves the abovementioned objects by providing a compression chamber comprising a frusto-conical shell, an end wall closing the base of said frusto-conical shell, a sealable hatch in said end wall and means to selectively vary the altitude of the truncated apex of the frusto-conical shell with respect to said end wall.

The chamber is preferably constructed of lightweight material such as aluminum or titanium to provide ease of transportation.

A preferred embodiment of the present invention will now be described, by way of example only, with reference to the accompanying drawings in which.

Figure 1:
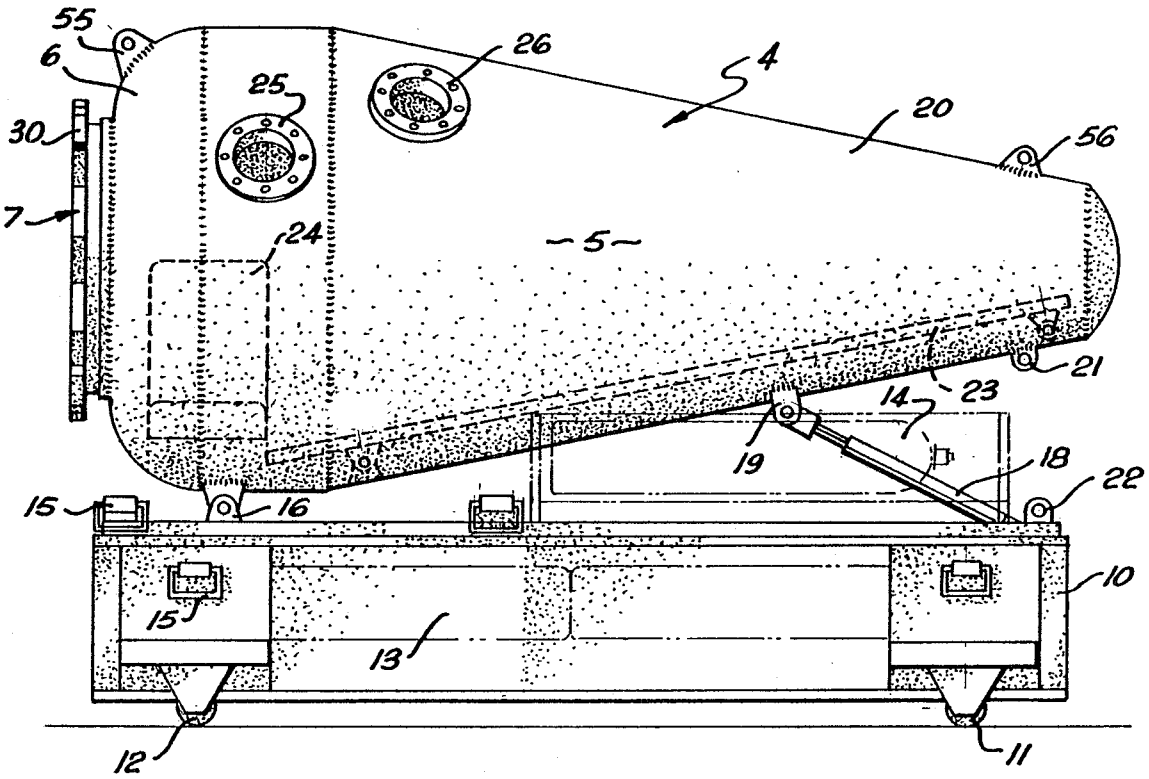
FIG. 1 is a side elevation of the recompression chamber according to the invention.
Figure 2:
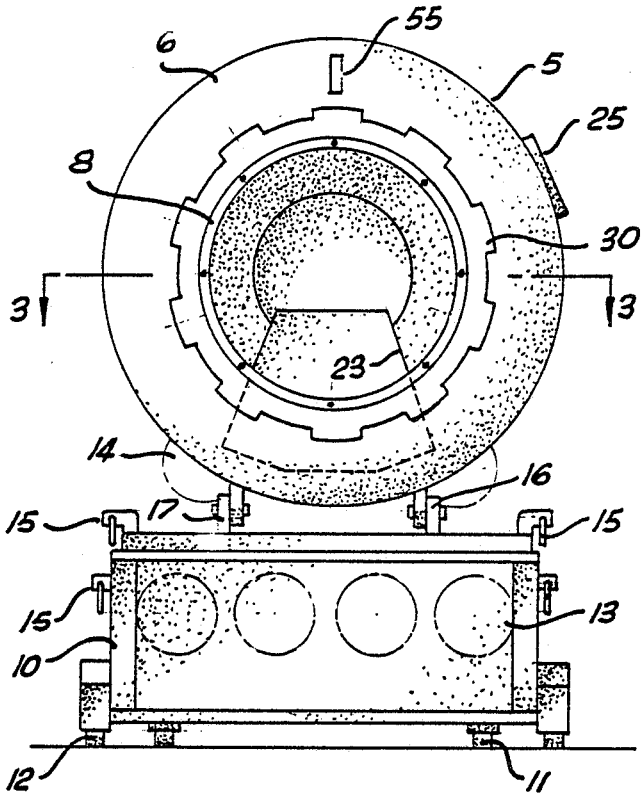
FIG. 2 is an end elevation of the recompression chamber of FIG. 1 when viewed from the hatch end.
Figure 3:
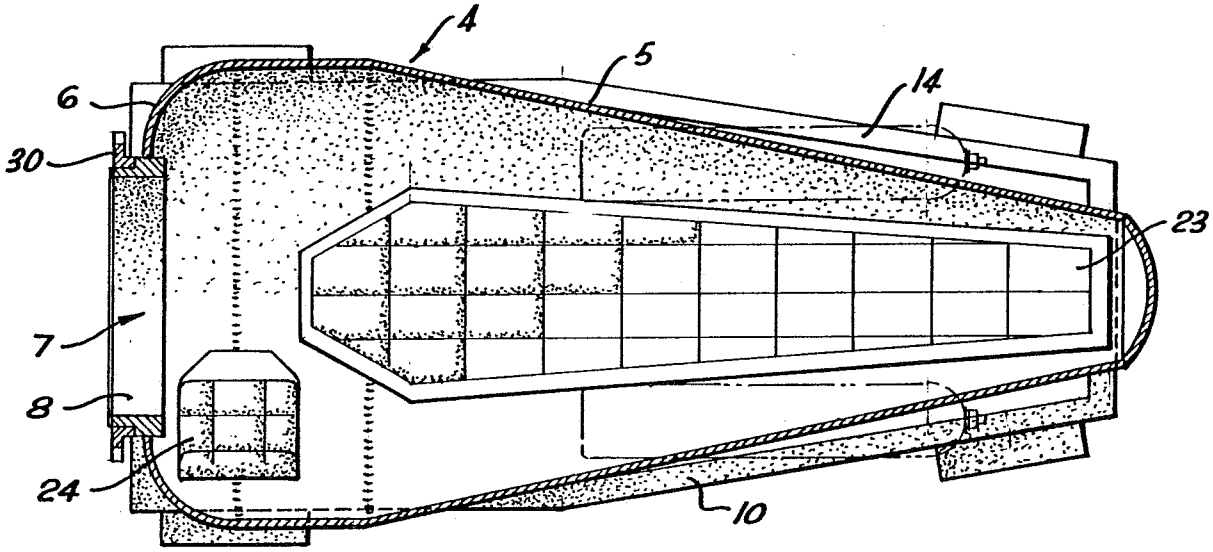
FIG. 3 is a cross-sectional view taken along lines 3—3 of FIG. 2.

The recompression chamber 4 comprises a substantially frusto-conical shell 5 and an end wall 6 closing the base of the frusto-conical shell. A sealable hatch 7 is provided in the end wall 6 which enables access to the interior of the recompression chamber.

The sealable hatch comprises a circular opening 8 and a corresponding but slightly larger circular cover 9.

Sealing means are provided inside the chamber and surrounding the opening so that when the cover is appropriately located its edge margin overlaps an edge margin of the opening and impinges upon the sealing means to thereby seal the hatch. The detailed operation of these sealing means will be described later with reference to FIG. 4.

The chamber 4 is mounted on a cart-like platform 10 which is supported by at least two pairs of spaced-apart wheels 11 and 12 adapted to rotate about respective stub axles (not shown) secured to said cart 10 and extending transversely of the longitudinal axis of the chamber 4. The cart 10 serves the dual purpose of supporting the chamber and holding the ancilliary equipment such as gas bottles 13 and 14. The cart 10 is also provided with a plurality of handles 15 at appropriate locations to assist in manoeuvring the chamber.

The chamber 4 is pivotally mounted on the cart 10 by means of pivot bearings 16 and 17 located on either side of the shell 5 and towards the hatch end of the chamber. The pivot bearings enable the chamber 4 to be tilted along its axis. The tilting action is achieved by a ram 18 extending from the cart 10 to a pivot point 19 on the truncated apex portion 20 of the shell. Mating eyes 21 and 22 located on the truncated apex portion 20 and the cart respectively, enable the chamber to be locked in its lowermost position.

It will be appreciated by those skilled in the art that any means to raise and lower the truncated apex of the frusto-conical shell in relation to the end wall may be used and a recompression chamber incorporating such means will fall within the scope of the present invention.

The recompression chamber is of sufficient dimensions to accommodate a patient in a lying down position with his feet towards the truncated apex of the frusto-conical shell and an attending medical technician sitting adjacent the hatch.

The tilting of the chamber is required to keep the patient's feet above his head, thereby drawing air embolisms upward and away from the brain and heart.

The interior of the chamber is provided with a removeable floor 23 on which the patient is supported either directly or on a bed located thereon. A folding seat 24 is provided adjacent the hatch end of the chamber to allow for seating of the attending medical technician during treatment of patient. Observation ports 25 and 26 are provided to enable outside viewing of the interior of the chamber.

The recompression chamber according to the present invention is intended to be transported to the site of an accident whereupon a patient and a medical technician may enter the chamber for immediate recompression to thereby stabilize the patient. Since the recompresion chamber is necessarily small it is desirable to transfer the patient and the technician to a larger recompression chamber. Since it is undesirable to randomly reduce the pressure in the recompression chamber during the treatment of a patient, even for the purposes of transferral to a larger chamber, the recompression chamber is provided with a so called "NATO" ring surrounding the hatch which enables the hatch of the recompression chamber to be sealed against the hatch of a second non-portable recompression chamber. When so sealed, the pressures in the respective chambers are equalised and their hatches removed to enable a technician and patient to be transferred from one chamber to another without reduction in their recompression pressures.

Figure 4:
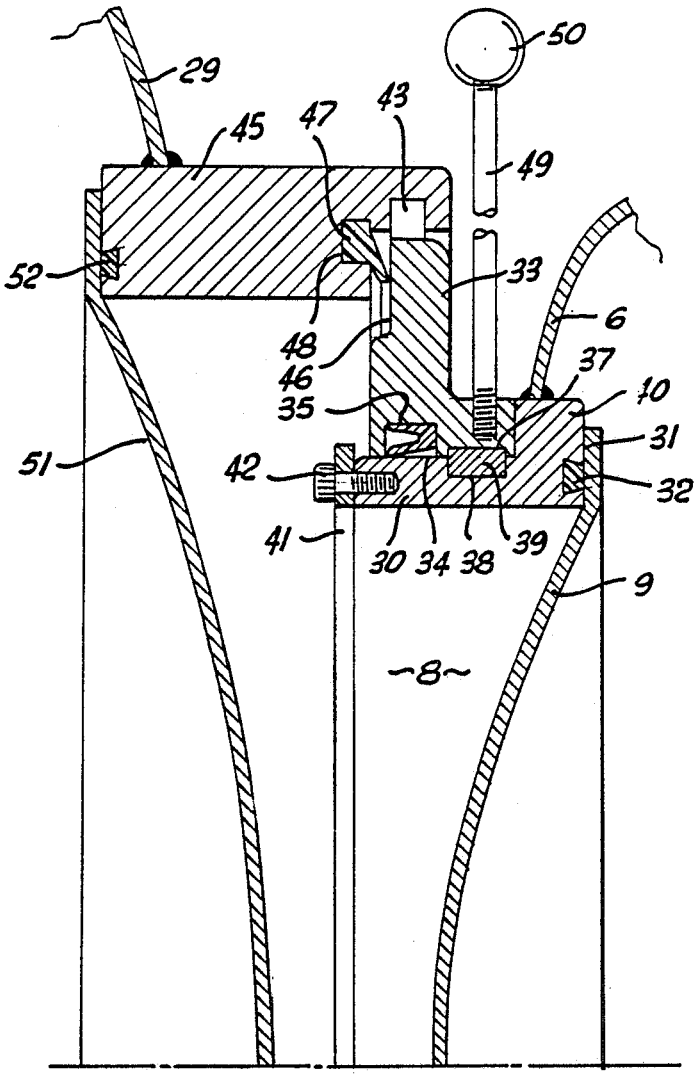
FIG. 4 is an enlarged cross-sectional view of the sealing arrangement according to the invention.

Referring to FIG. 4, the detailed arrangement of the "NATO" ring is shown when used to perform a transfer under pressure between the recompression chamber 4 according to the invention and a further chamber 29.

The "NATO" ring comprises a door ring 30 fitted to the end wall 6 of the chamber 4. Door ring 30 surrounds the opening 8 and cover 9 overlaps the edge margin 31 of the ring 30 and bears against sealing means 32 which in this embodiment comprises an O-ring seal. A further male bayonet ring 33 circumferentially and rotatably engages the radially outward surface 34 of door ring 30. Male bayonet ring 33 has a circumferential groove or slot 35 provided on its mating surface with said door ring 30 housing a radial seal 36. A further circumferential groove or slot 37 is provided inward of said slot 35 on the mating surface of said door ring and has a complementary groove or slot 38 provided on said male bayonet ring, said complementary slots 37 and 38 hold a split ring 39 to provide frictional resistance to rotational movement between the bayonet ring and door ring.

The bayonet ring 33 is axially retained on said door ring by an upstanding circumferential flange 40 which attaches the door ring 30 to the end wall 6. The bayonet ring 33 is prevented from slipping off said door ring 30 by a retaining ring 41 which is fixed to the outer surface of the door ring and has a larger outer radius than said door ring so as to overlap the joint between said door ring and the bayonet ring. The retaining ring is fixed in position by a threaded bolt 42.

The bayonet ring 33 is provided with a male bayonet fitting 43 adapted to rotatably engage a complementary female fitting 44 on the female bayonet ring 45 attached to the further chamber 29. The engaging surface 46 between the two fittings is provided with a circumferential seal 47 located in a circumferential slot 48 provided in the female bayonet ring. In use this seal 47 is compressed between the mating surfaces of the two rings and provides a pressure tight seal.

A lever 49 and associated handle 50 extend radially from the male bayonet ring 33 so as to enable rotation of this ring when locking the bayonet fitting.

The hatches 9 and 51 of the recompression chamber and further chamber respectively are of such of diameter as to overlap the edge margin of their respective openings and impinge upon seals 32 and 52 provided around the inner edges of the male and female bayonet rings 33 and 45.

In use the bayonet fittings of each chamber are brought into alignment and engaged by rotating the male bayonet fitting by means of lever 49. Once the bayonet fitting is locked an airtight seal is provided between the two chambers and the pressure therebetween may be equalised. Once this is done, the hatches 9 and 51 may be removed and a transfer under pressure performed. Once the transfer is complete, the reverse procedure may be performed.

To enable the recompression chamber to be lifted for transportation it is provided with a pair centrally located eyes which are adapted to receive a shackle.

The transfer of patient and medical technician from the recompression chamber to a second larger recompression chamber is obviously most desirable. However, when the recompression chamber is being used in isolated areas it may not be possible due to the distance involved to safely transport the recompression chamber. It will be appreciated that under such circumstances the medical technician would be compelled to remain on duty for an inordinate length of time.

To overcome this problem the present invention is provided with a secondary transfer chamber which is adapted to accommodate one person, to be closed in the same manner as the recompression chamber of the present invention and then to be pressurized, sealed against the recompression chamber by means of the "NATO" ring with the hatches aligned prior to those hatches being opened to enable the medical technician manning the recompression chamber to be relieved. The recompression chamber and the transfer chamber are both portable and enable prolonged isolated treatment of baratrauma patients.

The frusto-conical shape of the chamber provides several advantages over the conventional cylindrical shape. The narrow end reduces the overall envelope size occupied by the apparatus but allows ancilliary equipment such as the control panel, $CO_2$ scrubber, air supply, tilting apparatus to be located within the envelope defined by the larger end of the chamber. The chamber can also be tilted up at the apex while still remaining within the overall envelope size. Further, the chamber is less prone to cause claustrophobia since the patient's head is located at the widened end of the chamber where the space is perceived as opening out.

We claim:

1. A compression chamber for treatment of patients suffering baratrauma or the like, comprising a frusto-conical sheel, an end wall closing the base of said shell, a sealable hatch in said end wall to provide access to said chamber, said means to selectively vary the altitude of the truncated apex of the frusto-conical shell with respect to said end wall, said means to vary the altitude of said truncated apex comprising pivot means attached to said shell adjacent said end wall and fluid-operated ram means coupled to said truncated apex to raise and lower it with respect to said pivot means.

2. A compression chamber according to claim 1 wherein said sealable hatch comprises a circular oening and a corresponding but slightly larger circular cover, sealing means inside said chamber and surrounding said opening adapted to sealingly engage the edge margin of said cover where it overlaps the edge margin of said opening.

3. A compression chamber according to claim 1, wherein said ram means is air-operated.

4. A compression chamber according to claim 1 wherein said chamber is of sufficient dimensions to accommodate a patient in a lying down position with his feet towards the truncated apex of the frusto-conical shell and an attending medical technician sitting adjacent said hatch.

5. A compression chamber according to claim 1 wherein said hatch is provided with rotatable engagement means adapted to sealingly engage the hatch of a further compression chamber so as to provide for a transfer under pressure between said chambers.

6. A compression chamber according to claim 5 wherein said engagement means comprises a bayonet-type fitting rotatably and sealably mounted to said hatch.

7. A compression chamber according to claim 1 wherein said chamber is mounted on a wheeled trolley adapted to hold ancilliary equipment for operation of said chamber.

* * * * *